United States Patent [19]

Bjorklund et al.

[11] 4,152,287

[45] May 1, 1979

[54] METHOD FOR CALCINING RADIOACTIVE WASTES

[75] Inventors: William J. Bjorklund; Jack L. McElroy, both of Richland; John E. Mendel, Kennewick, all of Wash.

[73] Assignee: Exxon Nuclear Company, Inc., Bellevue, Wash.

[21] Appl. No.: 740,541

[22] Filed: Nov. 10, 1976

[51] Int. Cl.[2] ..... G21F 9/14; G21F 9/16

[52] U.S. Cl. ..... 252/301.1 W

[58] Field of Search ..... 252/301.1 W

[56] References Cited

U.S. PATENT DOCUMENTS 3,479,295 11/1969 Thompson ..... 252/301.1 W

OTHER PUBLICATIONS

Amphlett, C. B., *Treatment and Disposal of Radioactive Wastes,* Pergammon Press, New York, 1961, pp. 93–105.

*Primary Examiner*—Benjamin R. Padgett
*Assistant Examiner*—Deborah L. Kyle
*Attorney, Agent, or Firm*—Ronald D. Hantman

[57] ABSTRACT

This invention relates to a method for the preparation of radioactive wastes in a low leachability form by calcining the radioactive waste on a fluidized bed of glass frit, removing the calcined waste to melter to form a homogeneous melt of the glass and the calcined waste, and then solidifying the melt to encapsulate the radioactive calcine in a glass matrix.

12 Claims, 1 Drawing Figure

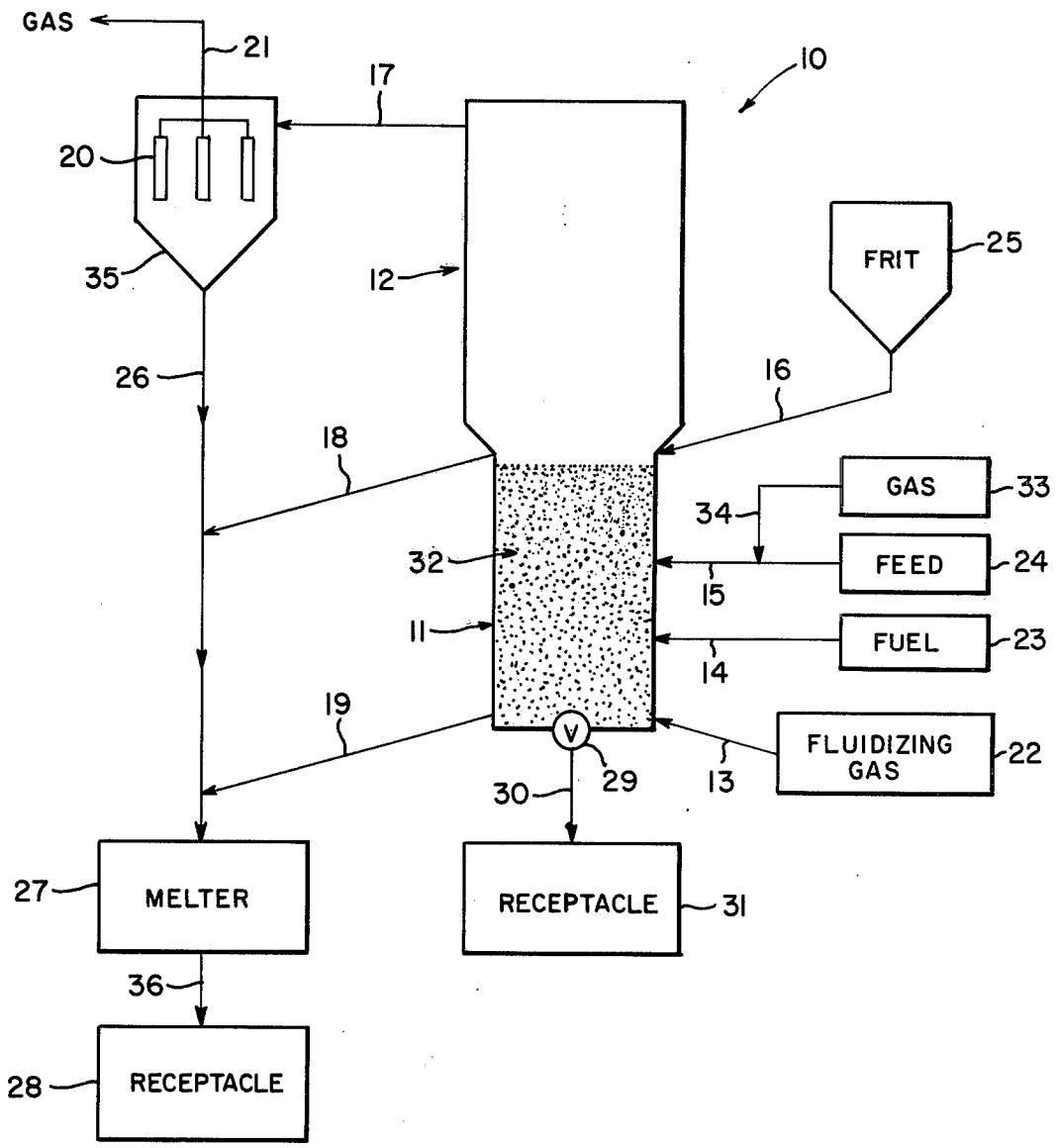
GAS
21
17
10
20
35
12
FRIT
25
26
16
18
GAS
33
34
32
FEED
24
15
11
FUEL
23
14
19
V
FLUIDIZING GAS
22
29
13
30
27
MELTER
RECEPTACLE
31
36
28
RECEPTACLE

METHOD FOR CALCINING RADIOACTIVE WASTES

BACKGROUND OF THE INVENTION

This invention relates to the solidification of radioactive liquid waste in a low leachability form.

Radioactive waste solutions are obtained in most conventional separation processes in which uranium, plutonium, or other radionuclides are recovered from irradiated nuclear fuels. Recovery methods are usually based on solvent extraction, on precipitation, or on ion exchange techniques. The aqueous waste solutions left after the separation processes contain the bulk of the radioactive fission products in a highly dilute form, salts that have been added and possibly reducing or oxidizing agents that were added for the conversion of actinides from one valence to another.

Disposal of liquid radioactive waste to the environment is undesirable since the wastes continue to release dangerous radiation for thousands of years. Liquid radioactive wastes are sometimes highly acidic and corrode or destroy containers, even those made of stainless steel or other resistant materials, after a very long period of time. For this reason, it is undesirable to bury liquid waste in the ground due to the possible contamination of ground waters or to dispose such waste at sea.

It is necessary to reduce the bulk of the waste solutions and to convert the radioactive fission products into water insoluble form. Prior art has attempted to accomplish this in a number of ways, such as by dehydration and calcination, as taught in the U.S. Pat. No. 3,008,904; solidification of the radioactive waste as taught by U.S. Pat. No. 3,507,801; and the use of a fluidized bed to calcine the radioactive material as described in U.S. Pat. No. 3,862,296 and in the article "Technical and Economic Comparison of Methods for Solidifying and Storing High-Activity Liquid Waste Arising in the Reprocessing of Irradiated Fuel Elements from Water-Cooled and Water-Moderated Reactors" from the Symposium on the Management of Radioactive Wastes from Fuel Reprocessing of the Organisation for Economic Co-Operation and Development in Paris, dated March, 1973. The prior art processes, while effective in reducing the volume of waste material and the problem of the corrosive nature of the waste, still have certain inherent drawbacks, particularly as regards the use of the fluidized bed to calcine the waste material. The fluidized bed resulted in a product which was finely divided and susceptible to leaching when exposed to water. Production of a granular product without excessive fines requires that the introduction of feed be closely controlled to produce particles within a narrow size range and that the elutriation of fines be kept low.

It has been proposed to calcine the radioactive waste, mix it with glass frit, e.g., a borosilicate glass frit, and then melt the mixture to form a mass of glass in which the radioactive material is dispersed. This produces a product which is very resistive to leaching. Such as process is disclosed in U.S. Atomic Energy Commission (or Energy Research and Development Administration) Report BNWL 1667. However, to secure a uniform product, it is necessary to mix the calcine and frit. The highly radioactive character of the calcine makes it necessary to have specialized mixing equipment, which adds to the cost and complexity of the plant.

SUMMARY OF THE INVENTION

The foregoing and other difficulties are overcome by the present method which utilizes a fluidized-bed calciner to simplify the conversion of liquid radioactive waste to a solidified glass form. The invention comprises, in brief, the proportional addition of a glass frit or similar material directly to a fluidized bed wherein it is coated or intimately mixed with radioactive calcine. The coated materials are of such a nature as to permit them to be drained and elutriated from the bed directly into a melter for conversion to glass which fixes the radioactive caline waste.

DESCRIPTION OF DRAWINGS

The drawing is the schematic presentation of the fluidized-bed embodiment along with associated equipment adapted for the calcination of liquid waste and subsequent conversion of the calcine to glass form which fixes the radioactive waste.

DETAILED DESCRIPTION OF THE INVENTION

In the process of this invention, concentrated high-level wastes are continuously injected into a fluidized bed of glass frit or similar material which serves as a reaction site for the decomposition, dehydration, and calcination of the wastes to solid oxides, water vapor, and decomposition gases. The solid oxides are calcined on the glass frit, which is present in the fluidized bed, and the coated material is continuously removed via elutriation and/or bed overflow. The glass frit bed material acts as diluent for the radioactive calcine being formed in the reactor and, thus, reduces the decay heat problem which would otherwise result from high inventory of fission products in the bed. The use of a non-radioactive bed material permits a wide range of waste compositions, including those relatively high in sodium concentrations, to be calcined without caking.

The invention involves creating a heated fluidized bed of glass particles fluidized by a gaseous medium such as air, nitrogen, or steam. Heated air is used to pre-heat the system until the bed reaches the autoignition temperature of kerosene, at which time kerosene is introduced through a spray system. Other means for heating the bed, such as with electric heaters or circulating fluids, would also suffice. The waste material is atomized with a gas and sprayed into the fluidized bed which is operated at temperatures sufficiently high to decompose any unstable salts in the radioactive material, forming principally oxides, but below the melting temperature of the bed material. The temperature may vary between about 300° C. and 1200° C. but generally will be between about 350° C. and 700° C. The atomized waste solution, which is mostly metallic nitrates and nitric acid, is dehydrated and decomposed to metallic and fission product oxides, which coat or are intimately mixed with the bed particles and gaseous products. The gaseous products and entrained particles are swept from the reaction zone with the fluidizing gas. As in known fluidized bed processes, the glass frit bed material is continuously added to the bed to replace the bed material which is constantly removed by elutriation and/or bed overflow. Bed material is added to adjust the mean diameter of the bed material to between about 100 to 400 microns. The use of the non-radioactive glass frit material as the bed material insures a low bed inventory of heat producing fission products. The calcined material which is entrained with the gases exiting the reactor is filtered from the gases and together with the calcine, which overflows from the reactor, is introduced to a melter wherein the calcine-containing glass frit is melted. The melt is then poured into a receptacle, degassed, and allowed to solidify or is further processed, for example, into glass beads.

Alternatively, the mixture may be melted directly in the receptacle, which is later allowed to cool.

The practice of the process is described in detail with reference to the figure in which the number 10 generally represents the vessel for conducting a fluidized bed process. The smaller diameter or constricted portion 11 contains the particulate medium 32 forming the fluidized bed and the larger idameter in the disengaging portion 12 which is substantially free of the fluidized bed. Portion 11 is heated by the combustion of fuels such as hydrogen, kerosens, butane, natural gas or other hydrocarbon fuels or, alternatively, by external heating, not shown, such as coiled electric resistance wiring placed adjacent to portion 11. In operation, fluidizing gas, such as air, is introduced into the portion 11 through line 13 which is connected to source 22 of the fluidizing gas. Fuel, such as kerosene, is introduced in the atomized form into portion 11 through line 14 which is connected to source 23 of the fuel. An oxidant, such as oxygen is introduced into portion 11 either through line 14, line 15 or through an alternate line not shown. The liquid waste is introduced in an atomized form to portion 11 of reactor 10 through line 15 which is connected to source 24 of the radioactive waste feed. The radioactive waste feed is atomized by introducing an atomizing gas from source 33 through line 34 which is connected with conduit 15. Alternatively, the waste feed may be injected under pressure through a spray nozzle. Intermittent or continuous withdrawal of the larger particles which settle to the bottom of portion 11 is conducted through line 19. Overflow line 18 provides a means for removal of a portion of the calcine material from the fluidized bed. The expanded portion 12 of reactor 10 is a disengaging portion which is of greater diameter than the cross-sectional areas of the lower portion 11 to permit disengaging particles from the gases. Gases and entrained particles exit reactor 10 by way of line 17 to the gas-solid separtor 35. Separator 35 is arranged for gas removal with filters 20 serving to retain any fine solids being carried with the gaseous medium exiting reactor 10 through line 17. The gas filters may be any convenient filter such as sintered metal filter elements with an nominal 3 micron retention capability or other gas-solid separators. The solid particles removed from the gaseous medium exiting reactor 10 are removed from separator 35 through line 26. Line 18 and line 19 from reactor 10 are interconnected with line 26 such that the solid particles overflowing from portion 11 through line 19 are intermixed in line 26 with the solid particles from separator 35 and the mixture is then introduced into melter 27. The calcine-coated glass bed material is melted in melter 27. The melt is then removed from melter 27 through line 36 to a receptacle 28 wherein the melt is allowed to solidify. In the event of the loss of fluidization, valve 29 would permit the flow of bed material through line 30 into receiver receptacle 31. In the alternative, line 30 could be connected to the melter 27.

Instead of using a separate melter, the receptacle 28 may be heated to a temperature sufficient to melt the glass frit.

In the practice of this invention, the fluidizing gases pass into portion 11 at a velocity sufficient to effectively fluidize the material to desired level by known art means. In general, the fluidizing gas is introduced at a controlled flow rate of about 0.9 to about 1.1 feet per second. An initial charge of particles having a size range of about 100 to 600 microns form the bed which is easily fluidized by a fluidizing medium. The bed material at start-up may be other than glass frit, such as alumina or silica, if temperatures higher than the melting point of the glass frit would be produced upon ignition of the fuel. Once operating temperature of the fluid bed is attained, glass frit would be added to replace the original bed material. The feed solution containing the radioactive waste is fed in atomized form into the fluidized bed at a rate appropriate to the calcination capacity of the calciner. When the radioactive waste material calcines on the particles in the fluidized bed, the particles are withdrawn from the fluidized bed at a rate controlled by the operator of the process.

The glass frit particles forming the fluidized bed can be of various glass compositions. The glass should be selected in order to provide the characteristics of the end product desired. Generally, borosilicate glass frit is the preferred material for forming the fluidized bed.

Since the invention is directed to the calcination of liquid waste containing radioactive materials, the fluidized-bed reactor for such a process must be mounted in a shielded space with a controlled atmosphere and equipped with remote controls for handling the materials. Various known materials for constructing fluidized bed reactors may be used for construction of reactor 10. Novel equipment design is not required for conducting the process of this invention.

The advantages of utilizing glass material as the bed material in a fluidized bed for the calcination of radioactive wastes include reducing decay heat removal problems due to reduced inventory of fission products, simplifying particle size and bed level control, eliminating mechanical equipment for mixing calcined waste and glass frit, and permitting a broader range of radioactive waste materials to be handled.

In this process, the ratio of glass to waste material may be varied as desired to meet operating and product form specification. Preferably, the ratio of bed material to waste material to be calcined should be from about 1.5 to 1 to about 5 to 1.

In one embodiment of the invention, the calcining vessel is a 6.75-inch square fluidized bed section with a 9-inch square disengaging section. A 12-inch diameter filter chamber, containing seven 36-inch long by 2.3-inch diameter sintered-metal filters, is used to remove entrained fines from the process off-gas. The filters are blown back periodically by a pulse of high pressure air to disengage the particulate matter. The filtered off-gas is then passed through a condenser and scrubber system for cleanup. During operation of this invention, the bed of borosilicate glass frit of about 300 microns is fluidized while process heat is supplied by the combustion of air and kerosene directly in the bed. Waste feed is introduced through an air-atomized nozzle and the calcination reaction occurs. Bed material is continuously added. A temperature of 500° C. is maintained in the bed. The calcine-coated particles are permitted to overflow and/or elutriate from the bed to maintain the proper bed inventory. The rate of bed solids addition is dependent on the glass forming step and needs to be in an excess of about 1.5 parts glass bed material to 1 part calcine.

The calcine product ranges from about 100 to 400 microns in mean diameter. The size of the calcine product is controlled by the rate of addition of the bed material, varying the feed rates, adjusting the atomizing gas rates, and varying the rate the bed material is removed from the reactor.

Having described above a preferred embodiment according to the present invention, it will occur to those skilled in the art that modifications and alternatives to the disclosed structure and process may be implemented within the spirit of the invention. It is accordingly intended to limit the scope of the invention only as indicated in the following claims.

We claim:

1. Process for the calcination of wastes containing radioactive materials which comprises establishing a heated bed of glass forming particles in a reactor, fluidizing the bed by gaseous medium, spraying wastes containing radioactive material into the fluidized bed whereby the metals and fission products in said waste material are calcined on the particles of the bed material and the remaining portion of the waste is vaporized, removing the glass forming particles and calcined waste from the reactor.

2. Process according to claim 1 wherein the glass forming particles are glass frit.

3. Process according to claim 1 wherein the glass forming particles are borosilicate glass.

4. Process according to claim 1 wherein the size of the glass forming particles have a mean diameter between 200 and 400 microns.

5. Process of claim 1 wherein the fluidized bed is maintained at a temperature of about 300° C. to 700° C.

6. Process according to claim 1 wherein the bed is heated by the combustion of fuel in the bed.

7. Process according to claim 1 further comprising the step of melting said glass forming particles and calcined waste.

8. Process for the vitrification of radioactive material which comprises establishing a bed of borosilicate glass frit having a mean diameter of between 200 and 400 microns in a reactor, fluidizing said bed with a gaseous medium, heating the bed to a temperature of from 300° C. to 800° C., introducing a liquid waste containing radioactive material into the fluidized bed in an atomized form whereby the radioactive material is calcined on the glass frit, removing the calcine-coated glass frit from the reactor to a melter, melting the radioactive calcined-coated glass frit, and cooling the melted glass-radioactive material.

9. Process according to claim 8 wherein the liquid waste contains ions of metals and fission products.

10. Process according to claim 8 wherein the metal and fission products are calcined on the glass frit.

11. Process according to claim 8 wherein the bed is heated by the combustion of kerosene in the bed.

12. Process according to claim 8 wherein the melted glass-radioactive material is removed from the melter prior to cooling.

* * * * *